US005609099A

United States Patent [19]

Burns et al.

[11] Patent Number: 5,609,099

[45] Date of Patent: Mar. 11, 1997

[54] PRESS SHUTHEIGHT ADJUSTMENT MECHANISM WITH HYDROSTATIC BEARING PADS

[75] Inventors: Bradley A. Burns, Wapakoneta; Brian A. Watercutter, Minster, both of Ohio

[73] Assignee: The Minster Machine Company, Minster, Ohio

[21] Appl. No.: 539,878

[22] Filed: Oct. 6, 1995

[51] Int. Cl.[6] ..... B30B 15/00

[52] U.S. Cl. ..... 100/257; 72/448; 72/453.13; 83/530; 100/259

[58] Field of Search ..... 100/257, 258 A, 100/259, 918; 72/448, 453.13; 83/530

[56] References Cited

U.S. PATENT DOCUMENTS

| | | | |
|---|---|---|---|
| 1,768,504 | 6/1930 | Byerlein | 72/448 |
| 1,866,595 | 7/1932 | Glasner et al. | 72/448 |
| 1,899,110 | 2/1933 | Rode | 72/448 |
| 3,858,432 | 1/1975 | Voorhees et al. | 72/455 |
| 4,096,798 | 6/1978 | Moskalik | 100/257 |
| 4,166,415 | 9/1979 | Spanke et al. | 100/53 |
| 4,206,699 | 6/1980 | Hemmelgarn | 100/53 |
| 4,289,066 | 9/1981 | Proga | 100/53 |
| 4,676,090 | 6/1987 | Nishimura et al. | 72/404 |
| 4,934,230 | 6/1990 | Wallis | 72/453.13 |
| 4,939,918 | 7/1990 | Schoch | 72/20 |
| 4,945,742 | 8/1990 | Schoch | 72/21 |
| 5,113,756 | 5/1992 | Fujii | 100/48 |
| 5,140,834 | 8/1992 | Kashiwagi et al. | 72/21 |
| 5,199,290 | 4/1993 | Kashiwagi et al. | 72/21 |
| 5,209,091 | 5/1993 | Koenigbauer et al. | 72/21 |
| 5,345,861 | 9/1994 | Brewer et al. | 100/257 |
| 5,456,165 | 10/1995 | Schockman et al. | 100/257 |

FOREIGN PATENT DOCUMENTS

| | | | |
|---|---|---|---|
| 1070790 | 8/1954 | France | 83/530 |
| 52-76781 | 6/1977 | Japan | 100/257 |

*Primary Examiner*—Stephen F. Gerrity
*Attorney, Agent, or Firm*—Randall J. Knuth

[57] ABSTRACT

A shutheight adjustment assembly of a mechanical press including an adjustment nut rotatably connected to an adjustment screw. Hydrostatic bearing pads are provided below the adjustment nut to reduce frictional forces associated with nut rotation and to provide a squeeze film thickness to withstand large press loadings. A hydraulic chamber supplied with pressurized fluid is positioned above the adjustment nut and produces a preload force on the hydrostatic bearing pads. Hydrostatic bearing pads are also arranged radially outward of the adjustment nut to radially center the nut during operation. A hydraulic chamber between the adjustment nut and screw may be furnished to resist bolster rebound during press operations.

23 Claims, 6 Drawing Sheets

PRESS SHUTHEIGHT ADJUSTMENT MECHANISM WITH HYDROSTATIC BEARING PADS

BACKGROUND OF THE INVENTION

The present invention relates generally to mechanical presses, and, in particular, to a mechanism utilized to adjust the spacing between the press bolster and slide to accurately control press shutheight.

Mechanical presses, such as stamping presses and drawing presses, include a frame structure having a crown and bed. A slide, which is supported within the frame for motion toward and away from the bed during operation, is typically driven by a crankshaft having a connecting arm connected to the slide. The slide is generally guided on the uprights of the press frame extending between the crown and the bed so that the parts of the die set remain in accurate registration as the slide reciprocates. Mechanical presses of this general type are widely used and vary substantially in size and available tonnage depending upon the intended use.

In prior art presses of this general type, a shutheight adjustment mechanism is often furnished such that the shutheight opening between the slide and the bolster or bed may be adjusted to accommodate various die sets. For example, the slide may be mounted by components which are essentially adjustable in length or position such that the slide may be shifted closer to or farther from the bolster. Alternatively, in designs such as disclosed in U.S. Pat. No. 3,858,432, the bolster of the press may be vertically shifted relative to the press bed such that the shutheight between the slide and bolster may be adjusted.

Operatively incorporated into their shutheight adjustment assemblies, many prior art mechanical presses include a plurality of bearings to reduce friction between the components which move during shutheight adjustment. Presses lacking these anti-friction bearings tend to require high adjustment torques due to sliding friction within the shutheight adjustment mechanism. However, these bearings are subjected to press stamping loads which can cause premature bearing failure. The bearing failure results in machine down time to perform the necessary replacement and maintenance. The stamping loads allowable in the press are also limited by the size or strength of the bearings. As the press load increases, the required size of the bearings increase. However, the larger size bearings tend to be less readily available from bearing suppliers.

Another shortcoming of anti-friction bearings commonly utilized in presses is that the bearings have fixed linear stiffness values. As the stamping loads applied to the bearing increase, the deflection of the bearing increases proportionally. Consequently, higher press loads may result in significant amounts of deflection that adversely impact press shutheight control.

In some shutheight adjustment mechanisms, hydraulic hold down pressure is utilized to lock the mechanism in a desired position. However, this pressure normally must be reduced or eliminated to adjust the shutheight, thereby adversely affecting the shutheight adjustment process.

Another shortcoming of many shutheight adjustment mechanisms pertains to the clearances provided between the component parts to facilitate their manufacture and assembly. These clearances increase the possible ranges of shutheight during press operation and may prevent the even transmission of pressure loads through the press. Uneven transmission of forces may cause particular parts, undergoing concentrated impact forces, to fail.

Thus, it would be desirable to provide a press with a shutheight adjustment assembly which may be used to overcome these shortcomings of the prior art.

SUMMARY OF THE INVENTION

The present invention provides a shutheight adjustment assembly for a mechanical press equipped with hydrostatic bearing pads rather than more conventional roller or ball bearings to realize a more reliable and effective assembly. A hydraulic chamber for preloading the bearing pads aids in limiting bolster deflection or movement resulting from punching, snapthrough and/or inertia forces of the press. The invention also employs radially arranged hydrostatic bearing pads to center the adjustment nut/screw engagement, and a hydraulic chamber to further limit bolster rebound.

In one form thereof, the present invention provides a mechanical press including a frame structure with a crown and a bed, a slide guided by the frame structure for reciprocating movement in opposed relation to the bed, a drive mechanism for reciprocating the slide, a bolster member mounted below the slide, and a shutheight adjustment assembly for moving the bolster member relative to the bed to adjust press shutheight. The assembly includes an adjustment nut comprising internal threads within a bore, and an adjustment screw comprising external threads threadedly engaged with the adjustment nut internal threads whereby relative rotation between the adjustment nut and the adjustment screw moves the adjustment screw in an axial direction relative to the adjustment nut. The adjustment nut and screw are associated with the bolster member and bed to move the bolster member relative to the bed upon relative rotation of the adjustment screw and nut. The assembly further includes at least one hydrostatic bearing pad arranged below either the adjustment nut or adjustment screw and above the bed for lifting the adjustment nut or adjustment screw in a direction toward the bolster member to reduce frictional resistance during relative rotation of the adjustment nut and screw. The assembly also includes at least one fluid conduit connecting a supply of pressurized fluid to the hydrostatic bearing pad.

In another form thereof, the present invention provides a shutheight adjustment assembly for moving a bolster member relative to a bed in a mechanical press. The assembly includes a housing positioned between the bolster member and the press bed, an adjustment nut disposed in a housing cavity, wherein the adjustment nut comprises internal threads within a bore, and an adjustment screw comprising external threads threadedly engaged with the adjustment nut internal threads whereby rotation of the adjustment nut moves the adjustment screw in an axial direction relative to the adjustment nut. The adjustment screw is associated with the bolster member and bed to move the bolster member relative to the bed upon rotation of the adjustment nut. The assembly also includes a plurality of hydrostatic bearing pads positioned radially outward of an adjustment nut outer radial peripheral surface and arranged for radially centering the adjustment nut in the housing cavity. The assembly also includes a plurality of fluid conduits providing pressurized fluid to the plurality of radially positioned hydrostatic bearing pads.

In still another form thereof, the present invention provides a shutheight adjustment assembly which includes a housing positioned between the bolster member and the bed of a mechanical press, an adjustment nut disposed in a housing cavity, wherein the adjustment nut comprises internal threads within a bore and an upper surface facing toward the bolster member. The assembly also includes at least one bearing, which is arranged below the adjustment nut and above the bed to reduce frictional resistance during adjustment nut rotation, and an adjustment screw comprising external threads threadedly engaged with the adjustment nut internal threads whereby rotation of the adjustment nut moves the adjustment screw in an axial direction relative to the adjustment nut. The adjustment screw is associated with the bolster member and bed to move the bolster member relative to the bed upon rotation of the adjustment nut. The assembly further includes a preload chamber between the housing and the adjustment nut upper surface, and at least one fluid conduit providing pressurized fluid to the preload chamber to bias the adjustment nut in a direction toward the press bed and thereby preload the at least one bearing.

One advantage of the shutheight adjustment assembly of the present invention is that the use of hydrostatic bearing pads to replace conventional anti-friction bearings reduces the likelihood of bearing failures that necessitate costly and inconvenient maintenance.

Another advantage of the present invention is that the hydrostatic bearing pads can be readily adapted for higher loads by increasing the supply fluid pressure to sufficiently replenish fluids squeezed out during the stamping loads.

Another advantage of the present invention is that the stiffness and load carrying capacity of the hydrostatic bearing pads are adjustable by varying the recess area pressure of the pads or varying a preload chamber pressure.

Another advantage of the present invention is that a hydraulic preloading of the bearing pad aids in limiting the amount of motion within the shutheight adjustment assembly experienced during press stamping loads in both the direction and opposite direction of the stamping load.

Another advantage of the present invention is that the hydrostatic bearing pads prevent contact between the surfaces to allow relative motion of mating components with minimal sliding or rubbing friction.

Another advantage of the present invention is that by utilizing hydrostatic bearings in conjunction with a hydraulic preload chamber, hydraulic pressure can remain constant throughout shutheight adjustment with minimal or no effect to the required adjustment torque.

Another advantage of the present invention is that the hydraulic anti-rebound chamber provides continual lubrication of the adjustment nut and screw threads.

Another advantage of the present invention is that clearance spaces between the adjustment nut, adjustment screw, and housing are filled with oil to reduce torque requirements during shutheight adjustment while the press is operating.

Still another advantage of the present invention is that the hydrostatic bearing pads are self compensating in terms of lost pressure, as cycling of the press allows oil or fluid to be injected into the pads to compensate for fluid loss.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
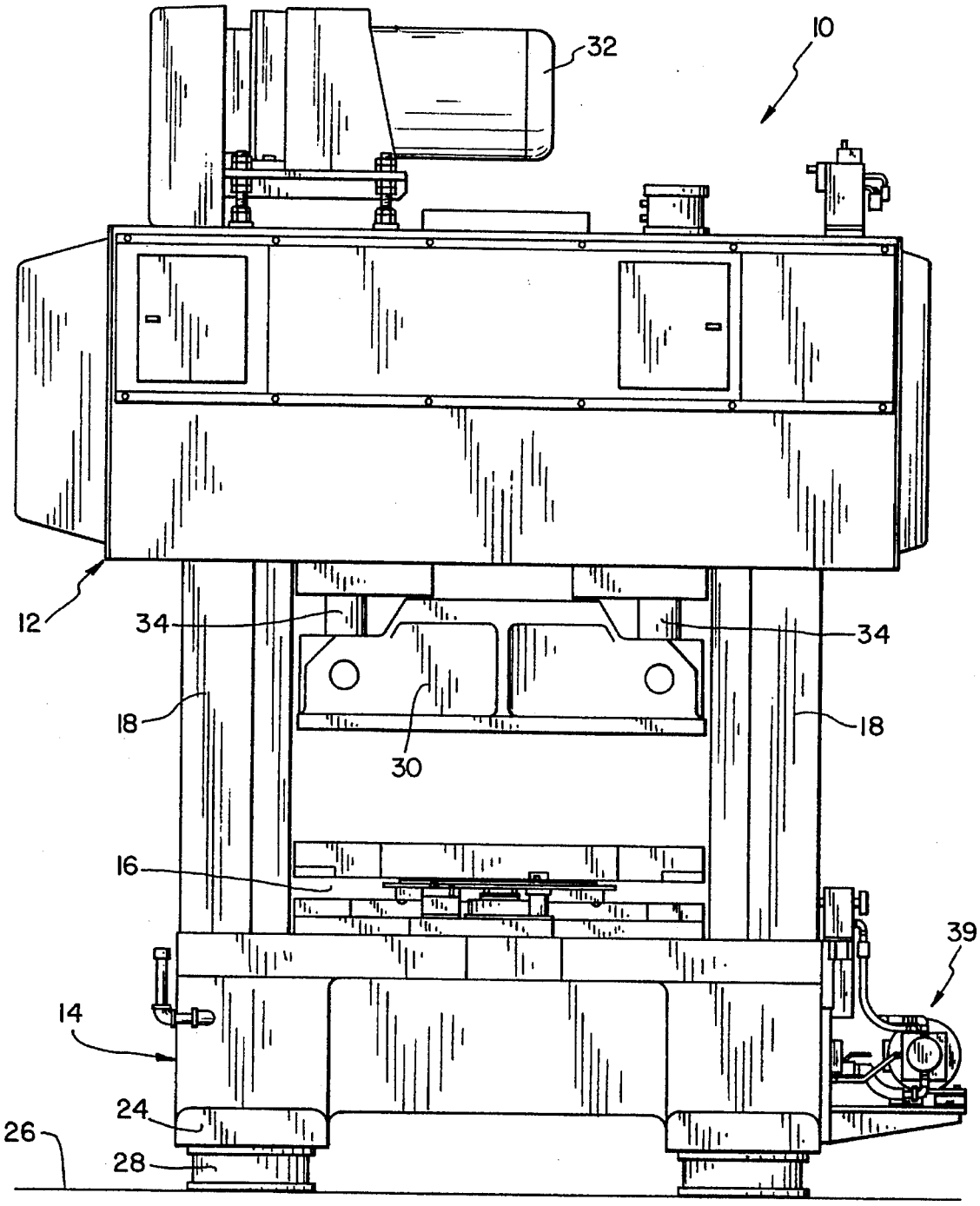
FIG. 1 is a front elevational view of a conventional mechanical press in which the shutheight adjustment assembly of the present invention is abstractly shown installed.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENT

Referring now to FIG. 1, there is shown a front view of a mechanical press, generally designated 10, with which the shutheight adjustment mechanism of the present invention may find beneficial application. Press 10 is of conventional design and includes a crown portion 12, a bed portion 14, and uprights 18 connecting crown portion 12 with bed portion 14. Uprights 18 are connected to or integral with the underside of crown 12 and the upper side of bed 14. Tie rods (not shown) extend through crown 12, uprights 18 and bed 14 and are secured on opposite ends with tie rod nuts. Leg members 24 are formed as an extension of bed 14 and are generally mounted on the shop floor 26 by means of shock absorbing pads 28.

A press drive motor 32 is mounted to crown 12 and used to operatively shift slide 30 in reciprocating fashion toward and away from bolster assembly 16 mounted on press bed 14. For example, drive motor 32 is connected by a clutch/brake mechanism (not shown) to a crankshaft to which connecting rods (not shown) are operatively attached. Other drive mechanisms known in the art may also be employed. A hydraulic pump 39 connected to press 10 may be employed to furnish the pressurized fluid, such as oil, that is required to operate the shutheight adjustment mechanism discussed further below. The above description of press 10 is not intended to so limit the invention as otherwise configured presses may be equipped with the shutheight inventive adjustment mechanism.

Figure 2:
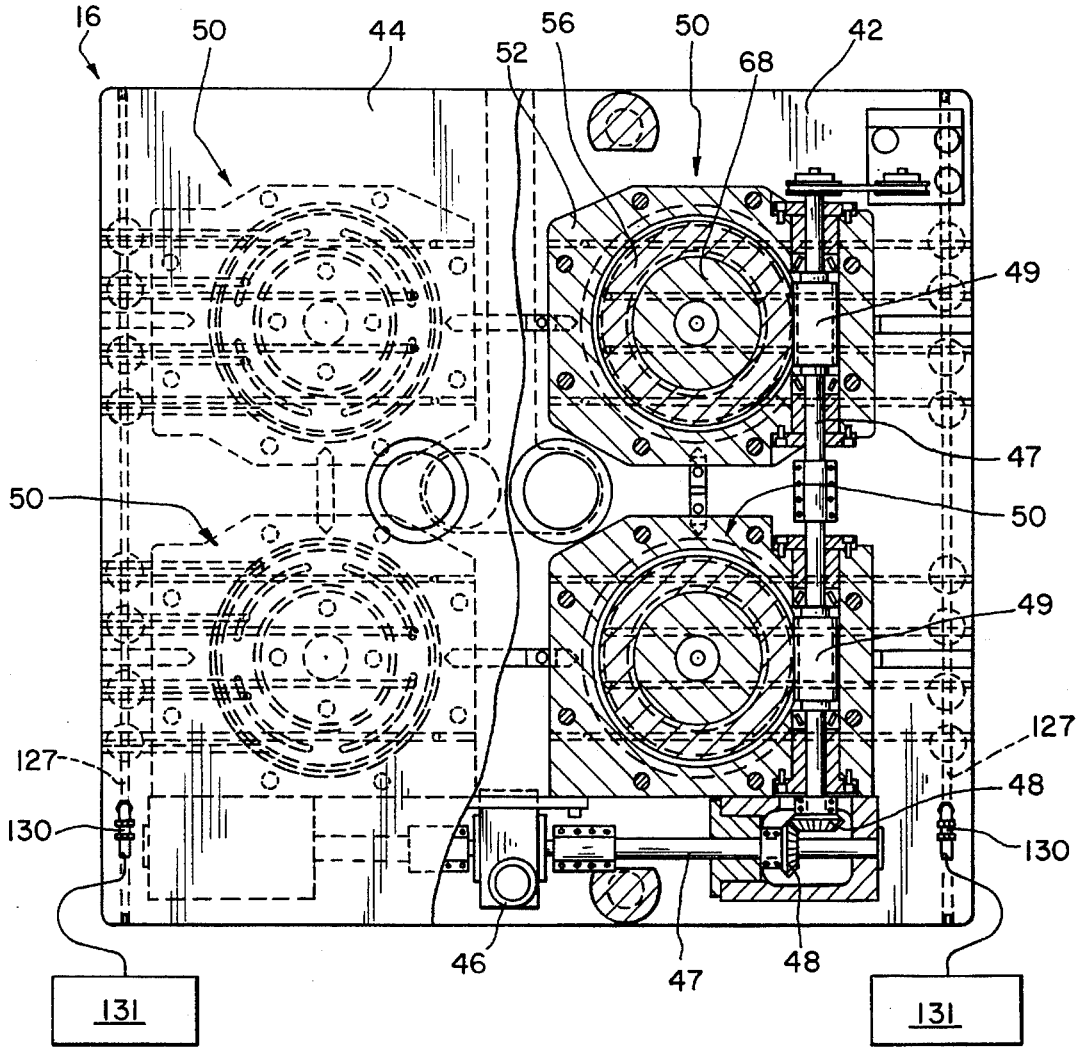
FIG. 2 is a diagrammatic plan view in partial section of the overall configuration of the bolster and shutheight adjustment assembly, wherein various portions of the press have been removed for purposes of illustration.
Figure 3:
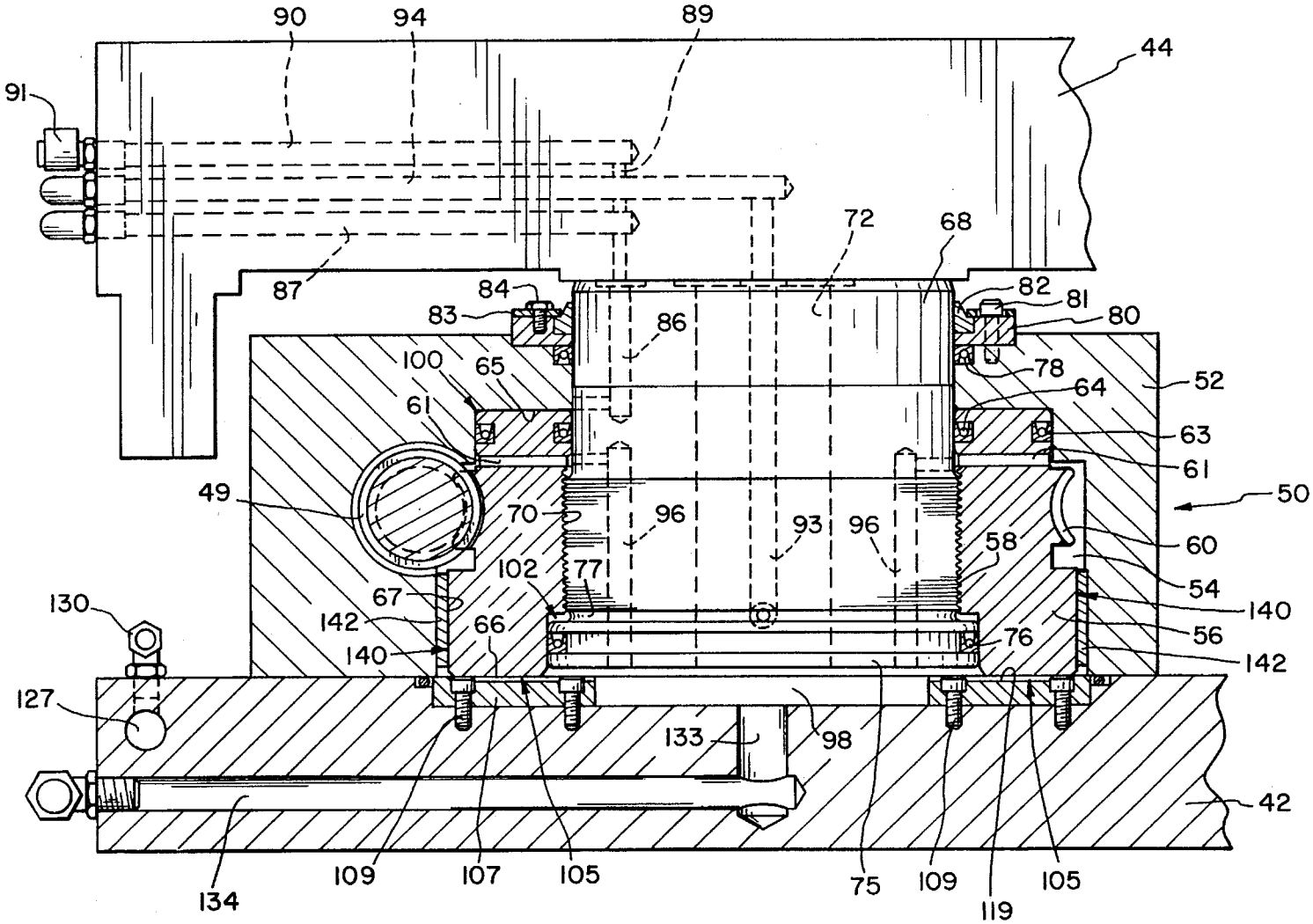
FIG. 3 is an enlarged, fragmentary front cross-sectional view of an adjustment nut/screw mechanism of the shutheight adjustment assembly showing only selected portions of the hydraulic fluid conduits.

Referring now to FIG. 2, bolster assembly 16 is shown diagrammatically in plan view removed from press 10. Bolster assembly 16 includes a base plate 42, which is securely mounted via mechanical fasteners on press bed portion 14, and a top plate 44 upon which a lower die shoe is mounted or provided. In the shown embodiment, the shutheight adjustment assembly of the invention is installed between base plate 42 and top plate 44 to effect adjustments in the vertical spacing therebetween to control the shutheight between slide 30 and top plate 44 (FIG. 3). Although base plate 42 is shown distinct from and mountable to bed portion 14, it is recognized that base plate 42 essentially serves as an extension of press bed 14 when secured thereto and could be eliminated should various press components described below with respect to base plate 42 be provided on or machined into the upper surface of press bed 14.

Still referring to FIG. 2, the shutheight adjustment assembly includes a plurality of adjustment nut/screw mechanisms 50 mounted beneath bolster top plate 44. Although four such mechanisms 50 are shown, depending upon the size and shape of press 10 as few as one mechanism or additional mechanisms may be employed within the scope of the invention. All four adjustment nut/screw mechanisms 50 are linked to a partially shown, common worm drive assembly for synchronized operation to raise or lower top plate 44. The drive assembly includes a single, hydraulically powered motor 46 driving journaled shafts 47, which in turn are rotatably coupled by beveled gears 48. Separate worm screw portions 49 fixed to shafts 47 are used to engage each of the mechanisms 50 in a manner further described below. Alternate drive assemblies for adjustment nut/screw mechanisms 50 are known in the art and may instead be utilized, including separate worm screw motors or different mechanical arrangements such as a chain/sprocket configuration.

Referring now to FIG. 3, there is shown a cross-sectional front view of a single adjustment nut/screw mechanism 50 which is representative of the general construction of all the mechanisms in the shown embodiment. Adjustment nut/screw mechanism 50 includes an outer housing 52 fixedly secured by bolts 53 (See FIG. 7) to the top surface of base plate 42. Rotatably supported within housing cavity 54 is adjustment nut 56. An axial bore of nut 56 is provided with internal threads 58 which are threadedly engaged with external threads 70 of adjustment screw 68. Threads 60 circumferentially extend around nut 56 and engage worm screw portion 49. At a height above threads 58, a pair of lubrication bores 61 spaced 180° apart are provided through nut 56 and open into a groove (not shown) which rings the entire inner diameter of nut 56. This groove allows communication with passages 96 in screw 68 for all angular orientations of nut 56. A pair of seals 63, 64 stationed in recesses in nut 56 respectively provide fluid tight seals between housing 52 and the outer diameter surface of nut 56, and screw 68 and the inner diameter surface of nut 56.

Adjustment screw 68 includes axial bore 72 to reduce weight and is fixedly attached by bolts 73 (See FIG. 7) to the underside of bolster top plate 44. As is conventional, the threaded engagement of threads 58, 70 causes adjustment screw 68 to move axially when adjustment nut 56 is rotated by screw portion 49 to thereby achieve a movement of top plate 44 relative to base plate 42 or press bed 14. Adjustment screw 68 includes a larger diameter head 75 at its bottom end which fits within a counterbore of nut 56. Seal 76 fitted within an annular recess in head 75 provides a fluid-tight seal between screw 68 and nut 56. At its upper end, screw 68 is encircled by seal 78 which prevents pressurized fluid in preload chamber 100 described further below from escaping. Seal 78 is secured by retainer clip 80 fastened to housing 52 by screws 81. Dirt wiper ring 82 is held in retainer 80 by ring 83 secured to retainer 80 with screws 84.

Drilled into the body of adjustment screw 68 are a number of passages through which hydraulic fluid is separately routed to the anti-rebound chamber, the preload chamber, and the fluid outlet. A first bored passage 86 outlets into one side of the annular preload chamber 100 formed between the top of housing cavity 54 and the annular, top surface 65 of nut 56. Bored passage 86 is in communication with drilled conduit or bore 87 in bolster top plate 44 that is in flow communication with a source of pressurized fluid. Drilled conduit 90 in bolster top plate 44 terminates at bleeder fitting 91 and is connected to conduit 87 via cross bore 89 to bleed off air from preload chamber 100. A second bored passage 93 outlets into annular groove 77 in the outer perimeter of screw 68 and thereby feeds the anti-rebound chamber 102 formed between nut 56 and screw 68. Bored passage 93 communicates with conduit 94 in bolster top plate 44 that is also in flow communication with a pressurized fluid source but which is not connected to cross bore 89. A pair of outlet passages 96 in screw 68 extend between lubrication bores 61 and a collection cavity 98 below screw 68.

Positioned beneath and in direct facing relationship with the annular bottom surface 66 of adjustment nut 56 are hydrostatic bearing pads, generally designated 105. As used herein, a hydrostatic bearing pad includes a recess area, at which high pressure fluid is introduced to provide support to the component above the bearing pad, and a sill area adjacent the recess area where fluid from the recess area overflows to provide squeeze film support. In the shown embodiment, bearing pads 105 are formed in part by an annular bronze plate 107 attached to bolster base plate 42 or bed 14 by fasteners such as machine bolts 109. Rather than using a removable plate 107 which is preferred due to the plate replaceability upon possible wear, hydrostatic bearing pads 105 could be formed directly into bolster base plate 42.

Figure 5:
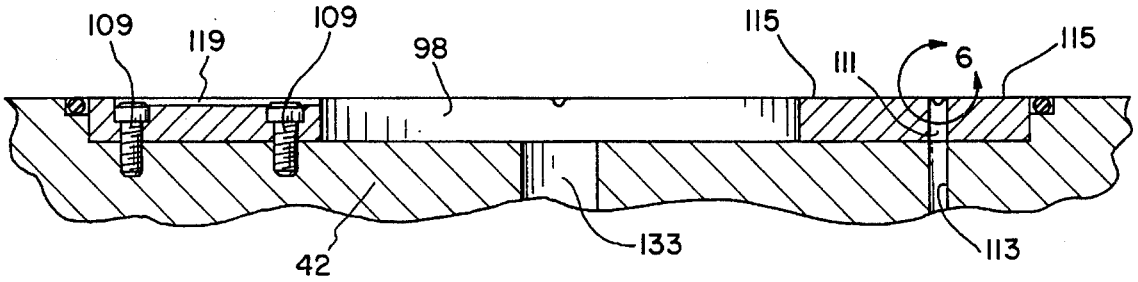
FIG. 5 is a side cross-sectional view of the hydrostatic bearing plate taken along line 5—5 of FIG. 4.
Figure 4:
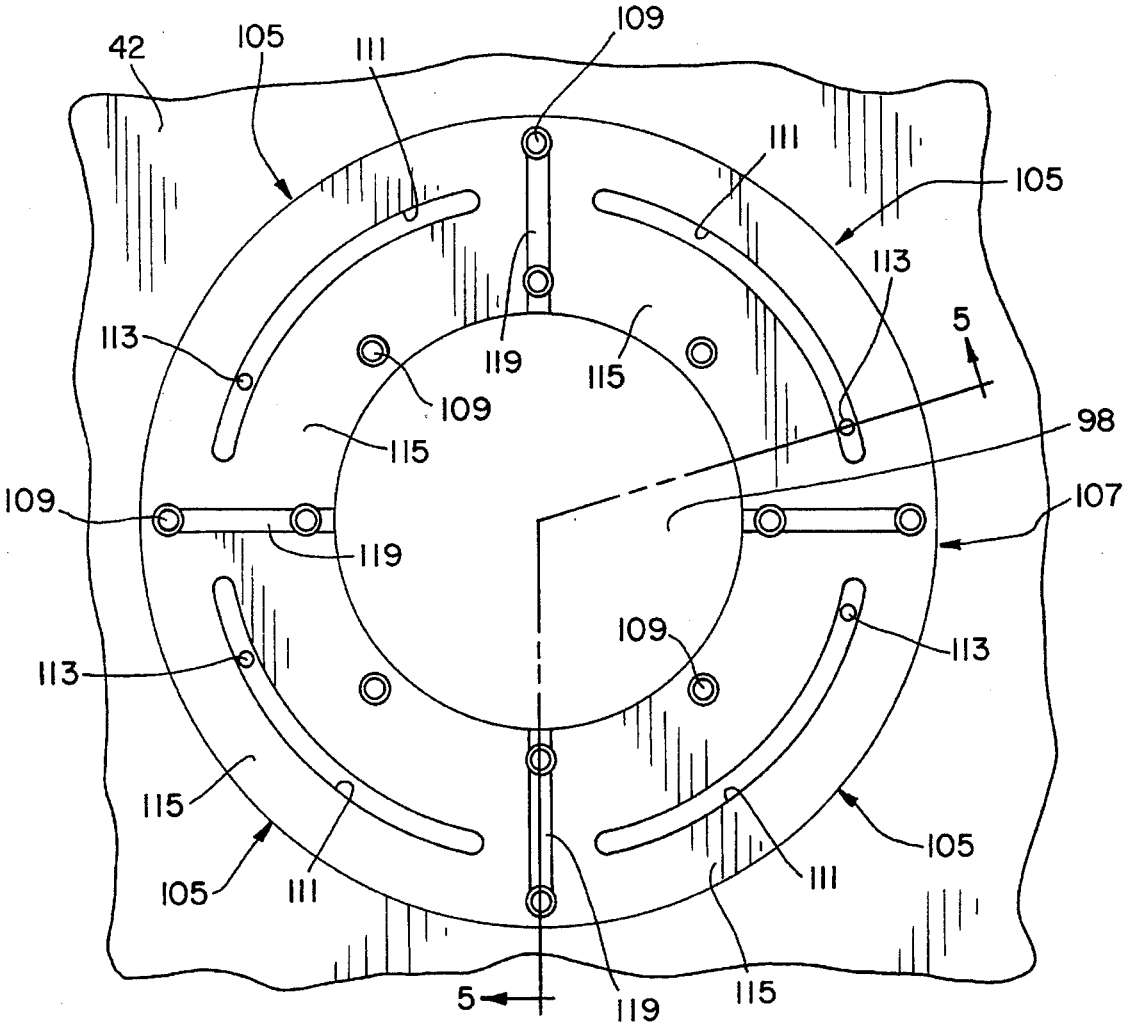
FIG. 4 is a plan view showing the hydrostatic bearing plate of FIG. 3.
Figure 6:
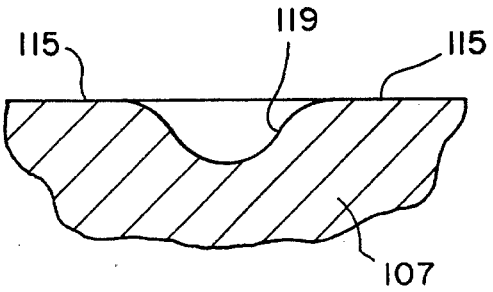
FIG. 6 is an enlarged, side view of a fluid collection groove of the hydrostatic bearing plate of FIG. 5.

As better shown in the plan view of FIG. 4, and in the cross-sectional view of FIGS. 5 and 6, hydrostatic bearing plate 107 is used to form two pair, or four, hydrostatic bearing pads 105. Bearing plate 107 includes four arcuate, elongate slots 111, arranged at even angular intervals, that serve as recess areas for the bearing pads. Recess areas 111 are each provided with a fluid inlet port 113 through which pressurized fluid is introduced in a manner described more fully below. Sill areas 115 are formed by the top surface of plate 107 and completely surround recess areas 111, such that fluid spilling over onto sill areas 115 from recess areas 111 thereby provides a high strength squeeze film support for press loadings. Sill areas 115 extend to the inner and outer radial periphery of plate 107 that forms the side walls of collection cavity 98. Radially aligned fluid collection grooves 119 are formed into bearing plate 107 to collect some of the fluid squeezed off of sill areas 115 by contact with nut 56 during press loadings. Grooves 119 drain collected fluid into collection cavity 98. As shown in FIG. 6, oil collection grooves 119 are substantially bell shaped in cross-section. Other recess and sill area configurations and quantities may be used within the scope of the invention. It is preferred that hydrostatic bearing pads 105 be provided in diametrically opposed pairs as shown such that during operation pads 105 tend to limit and correct slight tippings of screw 68 from vertical.

Figure 7:
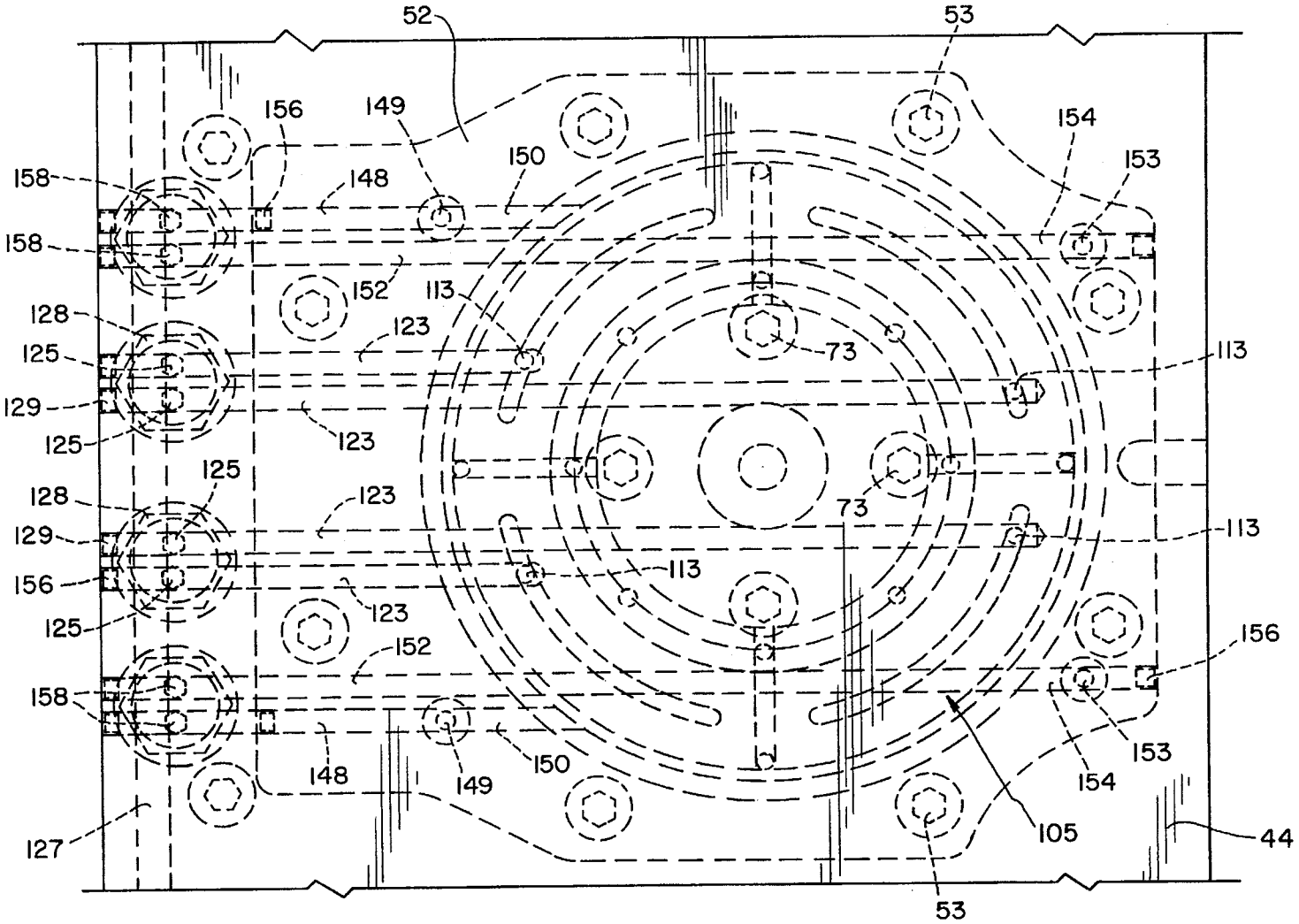
FIG. 7 is an enlarged fragmentary, plan view from FIG. 2 showing the conduits that supply pressurized fluid to the axially arranged and radially arranged hydrostatic bearing pads for the adjustment nut/screw mechanism of FIG. 3.

The fluid conduits providing pressurized hydraulic fluid such as oil to hydrostatic bearing pads 105 are best shown in FIG. 7. Separate bores or passages 123 are drilled/cross-drilled through bolster base plate 42 and communicate with fluid inlet ports 113. At their upstream ends, passages 123 are each provided with a compensating element such as an orifice 125 that opens into a common source line 127 of pressurized hydraulic fluid and that creates a pressure drop thereover. Pairs of conduits 123 are manifolded at orifice wells covered by plugs 128 to facilitate assembly. Plugs 129 plugging the ends of conduits 123 can be removed to permit monitoring by known means of the hydraulic pressure in hydrostatic bearing pads 105. As better shown in FIG. 2, source line 127 may be provided as a bore through bolster base plate 42 which is connected via elbow fitting 130 to an abstractly shown source 131 of pressurized oil.

As best shown in FIG. 3, fluid draining into collection cavity 98 passes through drain cross bore 133 and return bore or line 134 through bolster base plate 42 and subsequently through hoses to a press sump.

Figure 8:
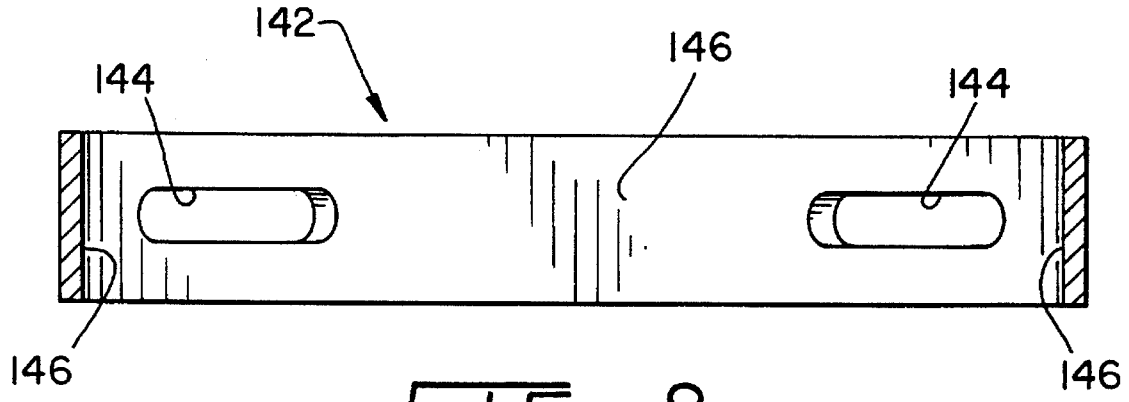
FIG. 8 is a front, cross-sectional view of the bushing employed in the radially arranged hydrostatic bearing pads.

To radially center adjustment nut 56, hydrostatic bearing pads, generally designated 140, are positioned radially outward of the cylindrical, outer radial peripheral surface 67 of adjustment nut 56. Although potentially formed directly into housing 52, in the shown embodiment bearing pads 140 comprise a cylindrical bushing 142 made of bronze adapted to closely fit into housing cavity 54 between the cylindrical interior wall of housing 52 and nut surface 67. As best shown in the cross-sectional view of FIG. 8 when removed from the remainder of the shutheight adjustment mechanism, bushing 142 includes four horizontal slots 144, spaced at 90° intervals, which serve as recess areas of the hydrostatic bearing pads. Fewer bearing pads, such as a two bearing configuration obtained with two diametrically opposed slots that achieves a centering return force when nut 56 experiences radial displacement, could be substituted for the shown four bearing configuration within the scope of the invention. The bushing inner diameter surface 146 serves as the sill area for bushing 142.

Referring again to FIG. 7, the fluid conduits supplying pressurized oil to the radially arranged hydrostatic bearing pads 140 are shown. The conduits are formed by aligned bores drilled/cross-drilled through bolster base plate 42 and housing 52. For example, conduits for the two hydrostatic bearing pads 140 closer to source line 127 each comprises a horizontal bore 148 through bolster base plate 42, a vertical bore 149 upward from bore 148 into housing 52, and a horizontal bore 150 through housing 52 porting into housing cavity 54 and more particularly into a bushing slot 144. Conduits for the other two hydrostatic bearing pads 140 each comprise an extended horizontal bore 152 through bolster base plate 42, a vertical bore 153 upward from bore 152 into housing 52, and a horizontal bore 154 through housing 52 porting into another bushing slot 144. Plugs 129, 156, are Shown in FIG. 7 within the ends of bores provided in base plate 42 and housing 52 to close off the drilling insertion points. Similar to the connection of passages 123, at their upstream ends pairs of horizontal bores 148, 152 are manifolded and provided with orifices 158 that open into source line 127 of pressurized hydraulic fluid.

The structure of shutheight adjustment assembly 50 will be further understood in view of the following explanation of its operation. To make an adjustment in press shutheight, motor 46 is actuated to cause worm screw portions 49 to rotate and cause adjustment nuts 56 to rotate, thereby raising or lowering screw 68 to raise or lower bolster top plate 44. Adjustments may be made while the press is idle or while the press is running under a stamping load. High pressure oil at recess areas 111 in hydrostatic bearing pads 105 lifts adjustment nut 56 off plate 107 and toward bolster top plate 44 to provide a clearance of between about 0.001 to 0.005 inches which will reduce friction during this adjustment nut rotation. In particular, pressurized fluid at about 1250 psi in bore 127 passes through orifices 125 and conduits 123 and into recess areas 111 through ports 113. Oil at recess areas 111 tends to be at about two-third supply line pressure due to the effect of orifices 125. High pressure fluid overflowing from recess areas 111 laterally spills over onto sill areas 115 as a film thickness of oil and experiences a pressure drop. During high intensity and short duration press loadings, the film thickness on sill areas 115 serves as a squeeze film bearing supportive of the stamping loads. The oil squeezed off of sill areas 115 by the press stamping loads flows inwardly over the inner radial periphery of bearing plate 107 and into collection cavity 98 as well as into oil collection grooves 119 that drain into cavity 98. The high pressure fluid source continually supplies pressurized oil to bearing pads 105 such that fluid squeezed out of the bearing pads during the compression stroke of the press is replenished, thereby keeping mating surfaces separated and lubricated. In addition, the supply pressure to bearing pads 105 can be adjusted to ensure sufficient oil is replenished for higher press loadings, as well as to vary the squeeze film thickness.

During press operation, hydraulic preload chamber 100 is utilized to allow the stiffness of the bolster to be adjusted to a desired setting. High pressure oil at an adjustable pressure of up to about 500 psi is supplied to passage 87 in top plate 44, passes downwardly through bored passage 86 and outlets into preload chamber 100. Cross bore 89, conduit 90, and fitting 91 are used to bleed air from the oil. By regulating the preload chamber pressure, the amount of clearance beneath adjustment nut 56 can be regulated, which in turn determines the stiffness of the squeeze film bearing that supports the assembly under press stamping loads. For instance, as the nut clearance is decreased by increasing the pressure within preload chamber 100, the bearing stiffness increases, which may be of benefit if an increase in press loads is desired. Preload chamber 100 also serves to reduce the rebound of the bolster. Chamber 100 has a low vertical clearance, such as around 0.002 inch, which acts as a squeeze film bearing to resist potential rebounding upward of nut 56 after experiencing a press stamping load.

The radially arranged hydrostatic bearing pads 140 function to center adjustment nut 56 within housing cavity 54 during operation. High pressure fluid introduced into recess areas 144 of bushing 142 through the drilled passages in the assembly provide radial support to nut 56 which counters any radial forces potentially caused by, for example, the worm screw engagement. The high pressure fluid which passes over seal areas 146 spills over into the housing cavity 54 to lubricate the worm gearing, passes through lubrication bore 61, through outlet bores 96, and down through collection cavity 98.

To further reduce rebound, pressurized hydraulic fluid or oil at up to 500 psi is supplied through conduit 94 and bored passage 93 into anti-rebound chamber 102. It will be appreciated that rebound of screw 68 upwardly relative to nut 56 after press loadings is dampened by the fluid filled chamber 102. Oil introduced in chamber 102 percolates upwardly through the engaged threads 58, 70, filling the clearance space which exists therebetween. In addition to continually lubricating the threads to reduce friction that would lead to increased adjustment torques and wear of the threads, the filling of the clearance space reduces the play between mated parts which could lead to shutheight variation. The fluid in the clearance space also provides a squeeze film between threads which further dampens rebound. A portion of the fluid from the clearance spaces may then pass outward through lubrication bores 61 to lubricate the worm screw engagement. The fluid from the clearance spaces ultimately drains through outlet bores 96 into collection cavity 98. Because fluid is not dead-ended in the clearance space but rather is cycled therethrough, cooler oil is continuously supplied which cools the adjustment nut/screw engagement. Oil collected within cavity 98 is routed back to the press sump and reused within the press.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press comprising:

a frame structure with a crown and a bed;

a slide guided by the frame structure for reciprocating movement in opposed relation to said bed;

a drive mechanism for reciprocating said slide;

a bolster member mounted below said slide; and a shutheight adjustment assembly for moving said bolster member relative to said bed to adjust press shutheight, said assembly comprising:

an adjustment nut comprising internal threads within a bore;

an adjustment screw comprising external threads threadedly engaged with said adjustment nut internal threads whereby relative rotation between said adjustment nut and said adjustment screw moves said adjustment screw in an axial direction relative to said adjustment nut, said adjustment nut and screw associated with said bolster member and said bed to move said bolster member relative to said bed upon relative rotation of said adjustment screw and nut;

at least one hydrostatic bearing pad arranged below at least one of said adjustment nut and said adjustment screw and above said bed for lifting said at least one of said adjustment nut and said adjustment screw in a direction toward said bolster member to reduce frictional resistance during relative rotation of said adjustment nut and screw; and at least one fluid conduit connecting a supply of pressurized fluid to said at least one hydrostatic bearing pad.

2. The press of claim 1 further comprising a housing positioned between said bolster member and said bed, wherein said adjustment nut is disposed in a housing cavity and includes a bottom surface, wherein said hydrostatic bearing pad comprises a top surface in direct facing relationship with said adjustment nut bottom surface, wherein said top surface comprises a recess area and a sill area, wherein said recess area is in communication with said fluid conduit, and wherein fluid overflowing from said recess area passes over said sill area thereby forming a squeeze film between said sill area and said adjustment nut bottom surface.

3. The press of claim 2 wherein said recess area comprises an elongate shape and is surrounded by said sill area.

4. The press of claim 2 wherein said adjustment nut bottom surface is generally annular, and wherein said at least one hydrostatic bearing pad comprises a plurality of hydrostatic bearing pads positioned at angular intervals below said annular bottom surface.

5. The press of claim 4 wherein said plurality of hydrostatic bearing pads comprises at least four hydrostatic bearing pads, and wherein the recess area of each of said at least four hydrostatic bearing pads is arcuate shaped.

6. The press of claim 4 wherein said top surface further comprises a plurality of radially oriented, fluid collection grooves arranged between adjacent hydrostatic bearing pads.

7. The press of claim 6 further comprising at least one outlet conduit communicating with said collection grooves for removing fluid from the assembly.

8. The press of claim 2 wherein said at least one hydrostatic bearing pad comprises a replaceable bearing plate and a plurality of fasteners for operationally securing said bearing plate to the press bed, said bearing plate comprising said top surface.

9. The press of claim 8 wherein said bearing plate is annular shaped, and wherein said at least one hydrostatic bearing pad comprises four hydrostatic bearing pads including arcuate recess areas, said four hydrostatic bearing pads arranged at angular intervals around said annular bearing plate.

10. The press of claim 9 wherein a central hole defined by said annular bearing plate is in flow communication with a conduit for outletting fluid squeezed off the sill areas at the inner radial periphery of said bearing plate.

11. The press of claim 1 further comprising a housing positioned between said bolster member and said bed, and a plurality of hydrostatic bearing pads positioned radially outward of an outer radial peripheral surface of said adjustment nut, said radially arranged pads in flow communication with a source of pressurized fluid and arranged for radially centering said adjustment nut in a housing cavity.

12. The press of claim 1 further comprising a housing positioned between said bolster member and said bed, and a preload chamber, between said housing and said at least one of said adjustment nut and said adjustment screw, in flow communication with a source of pressurized fluid to bias said at least one of said adjustment nut and said adjustment screw in a direction toward the press bed and thereby preload said at least one hydrostatic bearing pad.

13. The press of claim 1 wherein said adjustment screw and said adjustment nut are structured and arranged to define an anti-rebound chamber therebetween, said press further comprising at least one conduit for introducing fluid into said anti-rebound chamber, whereby said anti-rebound chamber when fluid filled dampens rebound of said adjustment screw relative to said adjustment nut.

14. A shutheight adjustment assembly for moving a bolster member relative to a bed in a mechanical press, the assembly comprising:

a housing positioned between the bolster member and the press bed;

an adjustment nut disposed in a housing cavity, said adjustment nut comprising internal threads within a bore, said adjustment nut further comprising an outer radial peripheral surface;

an adjustment screw comprising external threads threadedly engaged with said adjustment nut internal threads whereby rotation of said adjustment nut moves said adjustment screw in an axial direction relative to said adjustment nut, said adjustment screw associated with the bolster member and bed to move the bolster member relative to the bed upon rotation of said adjustment nut;

a plurality of hydrostatic bearing pads positioned radially outward of said adjustment nut outer radial peripheral surface and arranged for radially centering said adjustment nut in said housing cavity; and a plurality of fluid conduits providing pressurized fluid to said plurality of radially positioned hydrostatic bearing pads.

15. The shutheight adjustment assembly of claim 14 wherein said plurality of radially positioned hydrostatic bearing pads comprise sill areas surrounding recess areas, wherein said sill areas and said recess areas are in direct facing relationship with said adjustment nut outer radial peripheral surface, and wherein said recess areas are in flow communication with said fluid conduits.

16. The shutheight adjustment assembly of claim 15 wherein said plurality of radially positioned hydrostatic bearing pads comprises a cylindrical bushing adapted to fit within said housing cavity between said housing and said adjustment nut outer radial peripheral surface, wherein said bushing comprises said sill areas and said recess areas.

17. The shutheight adjustment assembly of claim 16 wherein said plurality of fluid conduits comprise passages bored within said housing.

18. A shutheight adjustment assembly for moving a bolster member relative to a bed in a mechanical press, the assembly comprising:

a housing positioned between the bolster member and the press bed;

an adjustment nut disposed in a housing cavity, said adjustment nut comprising internal threads within a bore, said adjustment nut further comprising an upper surface facing toward the bolster member;

at least one bearing arranged below said adjustment nut and above said bed to reduce frictional resistance during adjustment nut rotation;

an adjustment screw comprising external threads threadedly engaged with said adjustment nut internal threads whereby rotation of said adjustment nut moves said adjustment screw in an axial direction relative to said adjustment nut, said adjustment screw associated with the bolster member and bed to move the bolster member relative to the bed upon rotation of said adjustment nut;

a preload chamber between said housing and said adjustment nut upper surface; and at least one fluid conduit providing pressurized fluid to said preload chamber to bias said adjustment nut in a direction toward the press bed and thereby preload said at least one bearing.

19. The shutheight adjustment assembly of claim 18 wherein said preload chamber encircles said adjustment screw, and wherein said at least one fluid conduit comprises a passageway in said adjustment screw inletting into said preload chamber.

20. The shutheight adjustment assembly of claim 18 wherein said at least one bearing comprises a hydrostatic bearing pad, whereby adjustments of fluid pressure within said preload chamber varies the stiffness of said hydrostatic bearing pad.

21. A shutheight adjustment assembly for moving a bolster member relative to a bed in a mechanical press, the assembly comprising:

a housing positioned between the bolster member and the press bed;

an adjustment nut disposed in a housing cavity, said adjustment nut comprising internal threads within a bore;

an adjustment screw comprising external threads threadedly engaged with said adjustment nut internal threads whereby rotation of said adjustment nut moves said adjustment screw in an axial direction relative to said adjustment nut, said adjustment screw associated with the bolster member and bed to move the bolster member relative to the bed upon rotation of said adjustment nut;

wherein said adjustment screw and said adjustment nut are structured and arranged to define an anti-rebound chamber therebetween;

at least one conduit for introducing fluid into said anti-rebound chamber, whereby said anti-rebound chamber when fluid filled dampens rebound of said adjustment screw relative to said adjustment nut.

22. The shutheight adjustment assembly of claim 21 wherein said anti-rebound chamber is in flow communication with spaces within the threaded engagement of said adjustment nut internal threads and said adjustment screw external threads, and wherein fluid introduced into said anti-rebound chamber passes upwardly into said threaded engagement spaces.

23. The shutheight adjustment assembly of claim 22 wherein said assembly further comprises at least one outlet conduit for removing fluid in said spaces from the assembly, whereby during operation fluid is cycled through said fluid introducing conduit, through said chamber, through said threaded engagement spaces, and through said outlet conduit to thereby cool the assembly.

* * * * *